US006029868A

United States Patent [19]

Willinger et al.

[11] Patent Number: 6,029,868

[45] Date of Patent: Feb. 29, 2000

[54] GARMENT HANGER AND MARKER CLIP

[75] Inventors: Jonathan Willinger, Tenafly; Richard J. Caizza, Highland Lakes, both of N.J.

[73] Assignee: Randy Hangers, L.L.C., East Rutherford, N.J.

[21] Appl. No.: 09/190,498

[22] Filed: Nov. 12, 1998

[51] Int. Cl.[7] ..... A47G 25/14

[52] U.S. Cl. ..... 223/85; 40/322

[58] Field of Search ..... 223/85, 92, 88; 40/322

[56] References Cited

U.S. PATENT DOCUMENTS

| | | | |
|---|---|---|---|
| 4,115,940 | 9/1978 | Phillips | 40/322 |
| 4,679,340 | 7/1987 | Johansson | 40/322 |
| 4,997,114 | 3/1991 | Petrou | 223/85 |
| 5,069,373 | 12/1991 | Kolton et al. | 223/85 |
| 5,129,557 | 7/1992 | Kolton et al. | 223/91 |
| 5,449,099 | 9/1995 | Blanchard | 223/85 |
| 5,477,995 | 12/1995 | Dooley et al. | 223/85 |
| 5,586,697 | 12/1996 | Johansson | 223/85 |

*Primary Examiner*—Bibhu Mohanty
*Attorney, Agent, or Firm*—Helfgott & Karas, PC.

[57] ABSTRACT

A garment marker for indicating the size or other information about a garment being held on a hanger is fixed in place and restrained from moving within a socket formed on the hanger. The garment marker is formed as a resilient plastic sleeve having an open mouth which snaps around and over a rod located in the socket. The socket extends over the top and bottom of the garment marker to make manual removal of the garment marker difficult, without the use of a removal tool.

7 Claims, 7 Drawing Sheets

GARMENT HANGER AND MARKER CLIP

BACKGROUND OF THE INVENTION

1. Field of the Invention

The present invention relates in general to molded plastic clothing hangers having clip-on markers for indicating garment information such as size and cut. The invention particularly relates to such hangers having self-aligning clips which can be installed by hand but are highly resistant to removal without use of a removal tool.

2. Description of Prior Developments

Garment hangers having clip-on markers are known and have been in use for many years. Although such markers generally function satisfactorily, the clip-on markers are generally easy to remove by hand without the need for a removal tool. This facilitates unauthorized removal of the markers by vandals and can result in markers being switched between hangers so as to provide inaccurate garment information to a customer.

Another shortfall of prior clip-on markers of the cylindrical sleeve variety is their inability to maintain a desired alignment on the hanger. That is, such clips typically are designed to snap over a cylindrical rod and thereat rotate around the rod. This can place the garment information in a difficult to read position on the hanger.

Accordingly, a need exists for a garment hanger having a clip-on marker which can be easily installed by hand but which is difficult to remove without using a tool.

A further need exists for such a hanger and marker assembly which aligns the marker in a predetermined fixed position on the hanger so that garment information provided on the marker is always easily visible to a consumer or other interested party.

SUMMARY OF THE INVENTION

The present invention has been developed to fulfill the needs noted above and therefore has as an object the provision of a garment hanger and clip-on marker assembly which provides for the easy installation of the clip on the hanger without the use of a tool and which requires a tool for removing the marker from the hanger.

Another object of the invention is the provision of a garment hanger and clip-on marker assembly which aligns and fixes the marker on the hanger in a predetermined position so that information provided on the marker maintains a preferred orientation on the hanger.

Another object of the invention is the provision of a marker removal tool which is adapted to align with and engage the hanger and marker during removal of the marker.

These and other objects are met by the present invention which is directed to a garment hanger having a socket for receiving the cylindrical sleeve of a snap-on garment marker. The socket includes an alignment member such as a vertical rib which seats within an open mouth formed in the cylindrical sleeve of the marker.

A cylindrical rod is formed on the hanger for anchoring the sleeve thereon and a flat vertical abutment member such as a plate or wall on the hanger is aligned with the rod in a predetermined fixed orientation. When the marker sleeve is snapped over the rod, the open mouth on the sleeve is guided into engagement with the abutment member as a rib or projection on the abutment enters the open mouth thereby preventing the sleeve from rotating about the rod.

A pair of upper and lower marker guides, together with the flat abutment member, allow the marker to be easily guided over the cylindrical rod, but once the marker is snapped over the rod, the marker guides and abutment member restrict access to the maker thereby preventing easy removal of the marker by hand. In fact, a tool is preferably used to remove the marker from the hanger.

The aforementioned objects, features and advantages of the invention will, in part, be pointed out with particularity, and will, in part, become obvious from the following more detailed description of the invention, taken in conjunction with the accompanying drawings, which form an integral part thereof

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1:
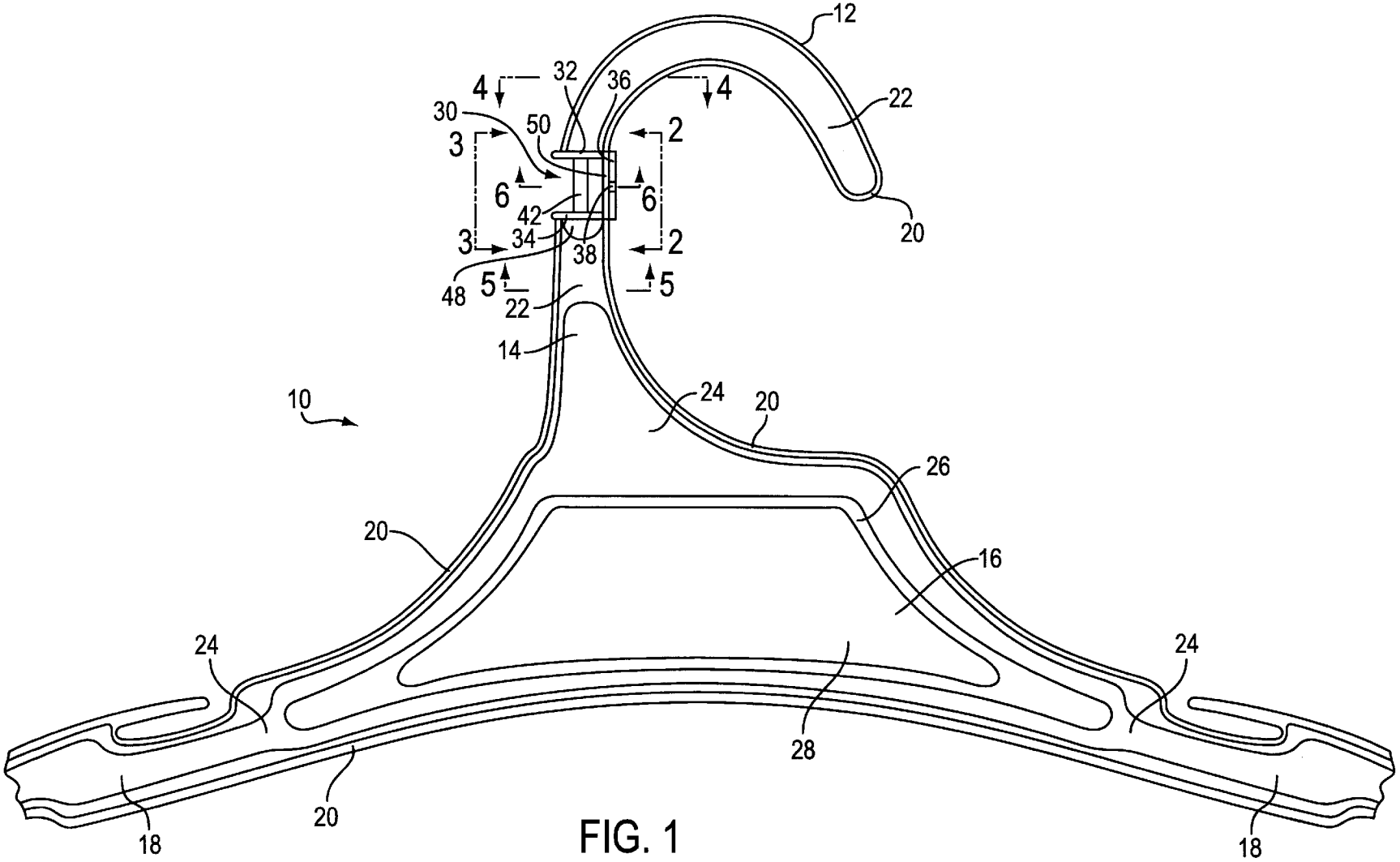
FIG. 1 is a front elevation view, partially in fragment, of a garment hanger constructed in accordance with the invention.

The present invention will now be described in conjunction with the drawings beginning with FIG. 1 which shows a garment hanger 10 constructed in accordance with the invention. Hanger 10 includes an upper hooked portion 12, a stem portion 14 supporting the hooked portion 12, a central base portion 16 supporting the stem and hooked portion and a pair of arms 18 extending laterally from and supported by the base portion 16. The entire hanger 10 may be homogeneously molded from plastic in a known fashion.

A strengthening rib or flange 20 is molded completely around the periphery of hanger 10. A recess 22 is defined between the flanges 20 on hooked portion 12 and on the upper portion of stem portion 14. The hanger 10 is further strengthened by a raised flat continuous planar surface portion 24, a groove 26 extending along the inner border of surface portion 24 and a somewhat trapezoidal central raised portion 28 coplanar with surface portion 24 and defined by groove 26.

The invention is particularly directed to a clip-on marker mounting structure depicted in FIG. 1 as socket 30. Socket 30 includes a flat upper roof or upper guide surface 32, a flat lower floor or lower guide surface 34 and an abutment member in the form of a flat vertical wall 36 interconnecting the upper and lower guide surfaces. Guide surfaces 32, 34 are preferably parallel with one another along horizontally extending planes and project outwardly from the hanger 10.

Figure 2:
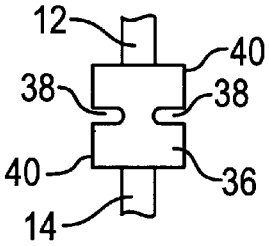
FIG. 2 is a right side view in fragment, taken along line 2—2 of FIG. 1.
Figure 3:
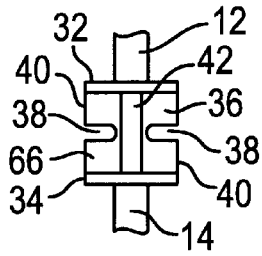
FIG. 3 is a left side view in fragment, taken along line 3—3 of FIG. 1.

As seen in FIGS. 2 and 3, wall 36 includes a tool release access portion in the form of a pair of horizontal or lateral slots 38. Although only one slot 38 could be provided, two are preferred, located about midway between the upper and lower guide surfaces 32, 34 and extending inwardly toward one another from the opposite sides 40 of wall 36.

A cylindrical rod 42 interconnects the central portions of the upper and lower guide surfaces 32, 34 and serves as an anchor post for receiving a clip-on garment marker as discussed further below. Rod 42 also provides significant strength to the lower end of the hooked portion 12.

Figure 4:
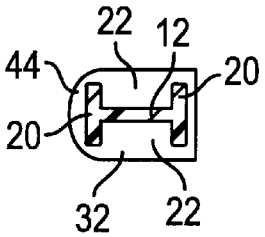
FIG. 4 is a view in section taken through section line 4—4 of FIG. 1.
Figure 5:
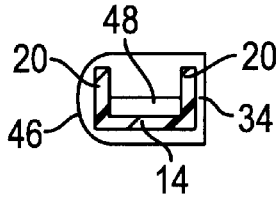
FIG. 5 is a view in section taken through section line 5—5 of FIG. 1.

As seen in FIG. 4, the outer edge 44 of the upper guide surface 32 is rounded in a generally semicircular profile to somewhat match and align over a portion of the circular profile of the garment marker discussed below. The outer edge 46 of the lower guide surface 34 has a similar semicircular profile as seen in FIG. 5. A raised semicircular strengthening base 48 is formed directly beneath the lower guide surface 34 as shown in FIGS. 1 and 5.

Figure 6:
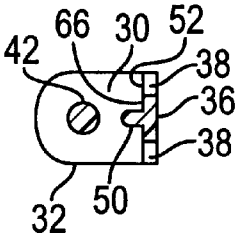
FIG. 6 is a view in section taken through section line 6—6 of FIG. 1.

In order to properly align a garment marker in pocket 30, a vertical rib 50 extends centrally along the inner surface 52 of wall 36. Rib 50 is aligned parallel with rod 42 and extends outwardly from wall 36 toward rod 42 as shown in FIG. 6.

Figure 7:
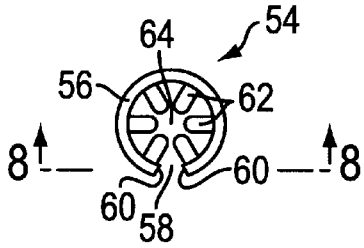
FIG. 7 is a top plan view of a marker clip constructed in accordance with the invention.
Figure 8:
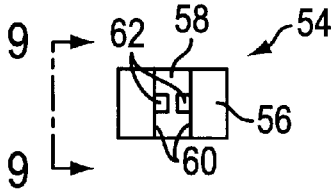
FIG. 8 is an elevation view of the marker of FIG. 7 taken from line 8—8 of FIG. 7.
Figure 9:
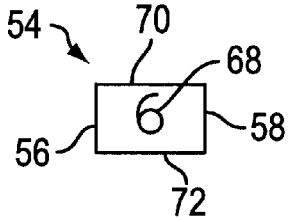
FIG. 9 is a left side view of the marker of FIG. 8, taken from line 9—9 of FIG. 8.

In order to provide information about a garment or other article suspended from hanger 10, a garment marker 54 is provided as shown in FIGS. 7, 8 and 9. Marker 54 may be formed as a substantially cylindrical plastic band or sleeve 56 having an open mouth 58 defined between two opposing vertical edges 60 of sleeve 56.

Figure 11:
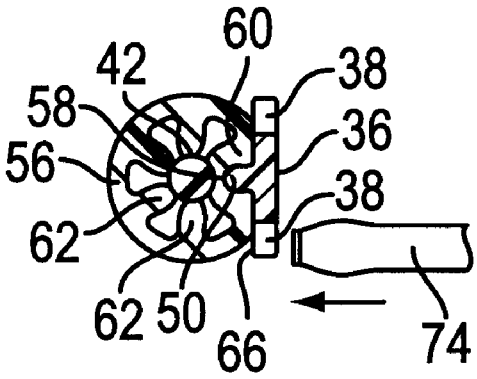
FIG. 11 is a view in section taken through section line 11—11 of FIG. 10 and showing one manner of marker removal.

A spoked array of resilient retention fingers 62 extends radially inwardly from the inner wall of sleeve 56 to define a central opening 64 for receiving rod 42 on hanger 10 as shown in FIGS. 7 and 11. When the mouth 58 of marker 54 is pushed against rod 42, the edges 60 of sleeve 56 resiliently spread apart in the manner of a C-clip.

When the rod 42 slips through fingers 62 and into the central opening 54, the edges 60 of sleeve 56 abut the inner face 66 of wall 36 on opposite sides of rib 50. In this manner, the fingers 62 and rib 50 prevent the marker 54 from moving in socket 30. Rib 50 prevents rotation of marker 54 around rod 42 by engagement with edges 60, and fingers 62 prevent translation of the marker 54 within socket 30.

Figure 10:
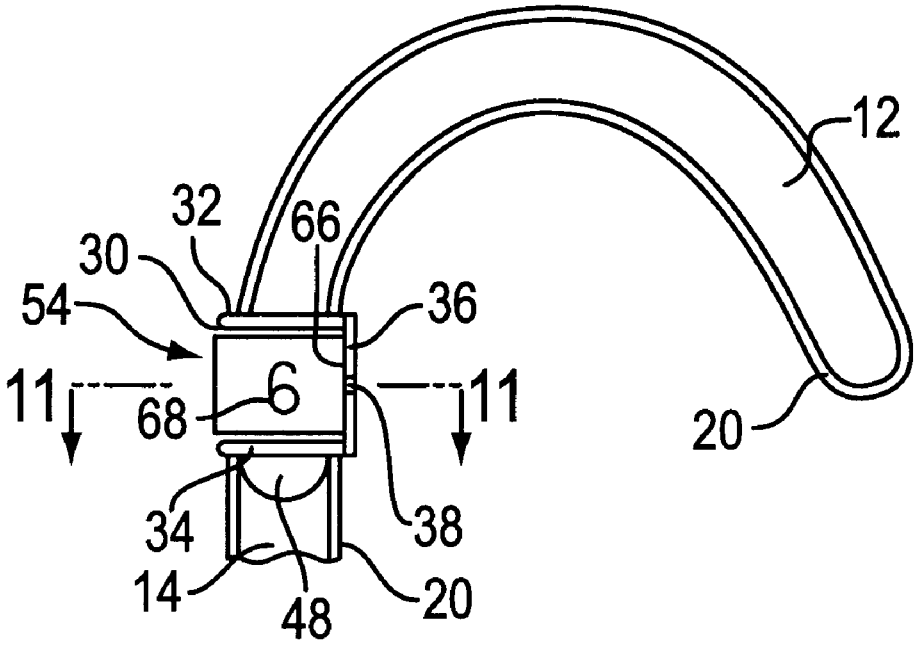
FIG. 10 is a front elevation view in fragment of the hanger of FIG. 1, fitted with the marker of FIG. 7.

As seen in FIGS. 9 and 10, if information or other indicia 68 such as garment size, material, or garment cut or style are provided on the sides of sleeve 56 at predetermined positions, such as at a position circumferentially spaced 90° from mouth 58, the indicia 68 will be presented and maintained in a predetermined position when the marker 54 is snapped onto the hanger 10. As further seen in FIG. 10, when the marker 54 is fully seated in socket 30, the upper and lower edges 70, 72 of the sleeve 56 (FIG. 9) are closely spaced from the upper and lower guide surfaces 32, 34 and there is little if any space between edges 60 of sleeve 56 and the inner face 66 of wall 36. In effect, the marker 54 is locked into socket 30 in such a manner that only the outer cylindrical surface of sleeve 56 is exposed. The resilient retention force of plastic fingers 62 around plastic rod 42 is set high enough to prevent most users from sliding, pushing or pulling the marker 54 off of rod 42. Moreover, because the only significant exposed finger gripping surface for applying a removal force to the marker 54 is a smooth cylindrical surface, one's fingers tend to lose their grip and slide over the sleeve 56 rather than pull it loose.

This condition necessitates the use of a removal tool. The slots 38 in wall 36 are provided to allow limited access to the sleeve 56 adjacent its mouth 58. For example, as shown in FIG. 11, the thin blade of a removal tool such as screwdriver 74 can be pushed into either slot 38 to pry open mouth 58 and dislodge and remove the marker from socket 30. Other specialized removal tools could, of course, be used as well.

Figure 12:
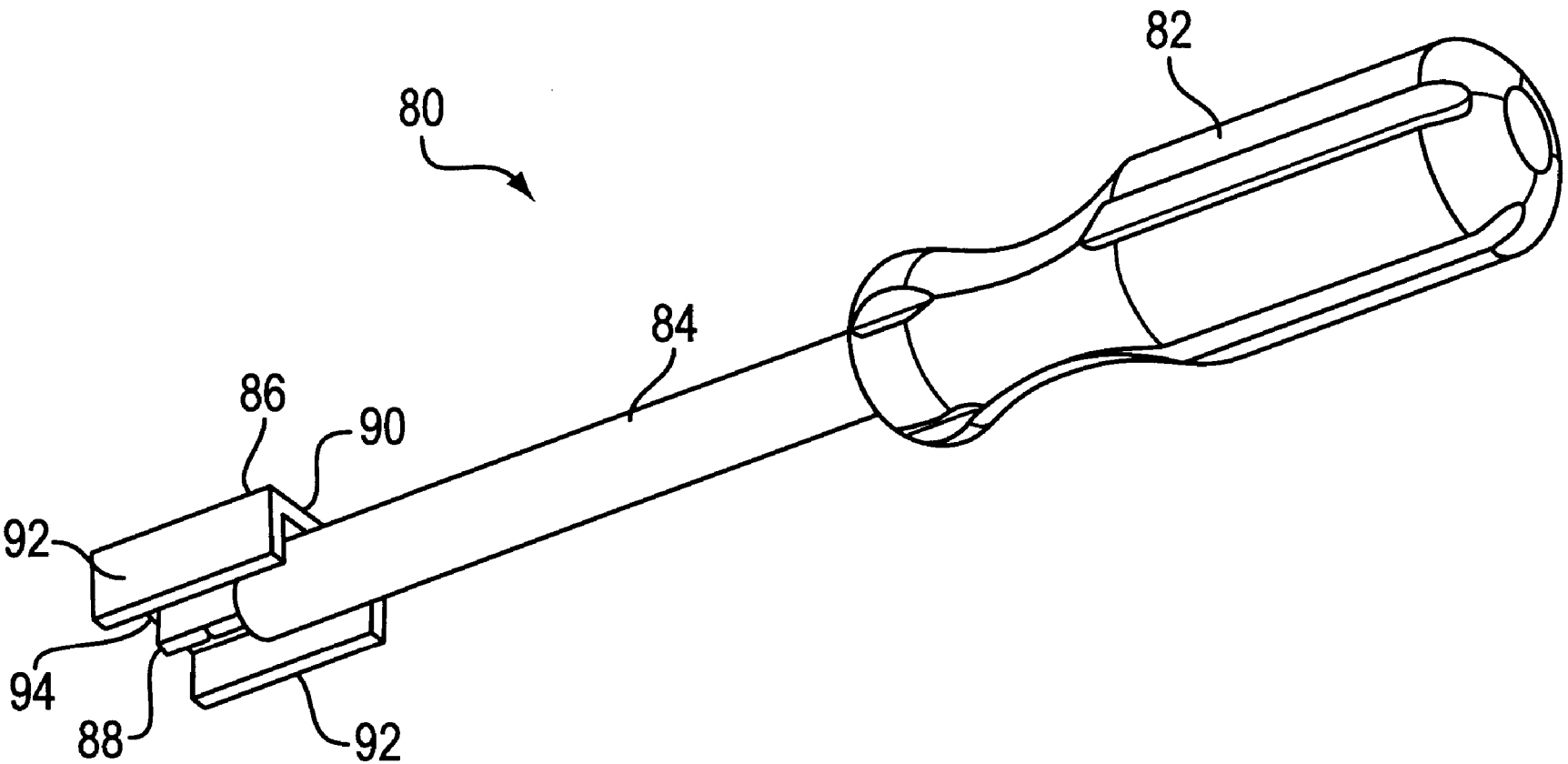
FIG. 12 is a perspective view of a hand tool adapted to remove the marker clip of FIG. 2 from the hanger of FIG. 1.

For example, as seen in FIG. 12, a specialized removal tool 80 includes a handle 82, shaft 84 and a removal head 86 connected to the end of the shaft 84. The removal head 86 is shaped to mate with the outer roof and floor portions of guide surfaces 32, 34 on the hanger 10 and thereby align a removal prong in the form of removal blade 88 with one of the slots 38 in socket 30.

Removal head 86 includes a base wall 90 and a pair of axially-extending alignment side walls 92 aligned perpendicular to the base wall 90 along its opposite axially-extending edges. In this manner, a somewhat U-shaped channel is formed around the removal blade 88, with the removal blade 88 extending axially along the inner surface 94 of base wall 90 midway between the side walls 92.

Figure 13:
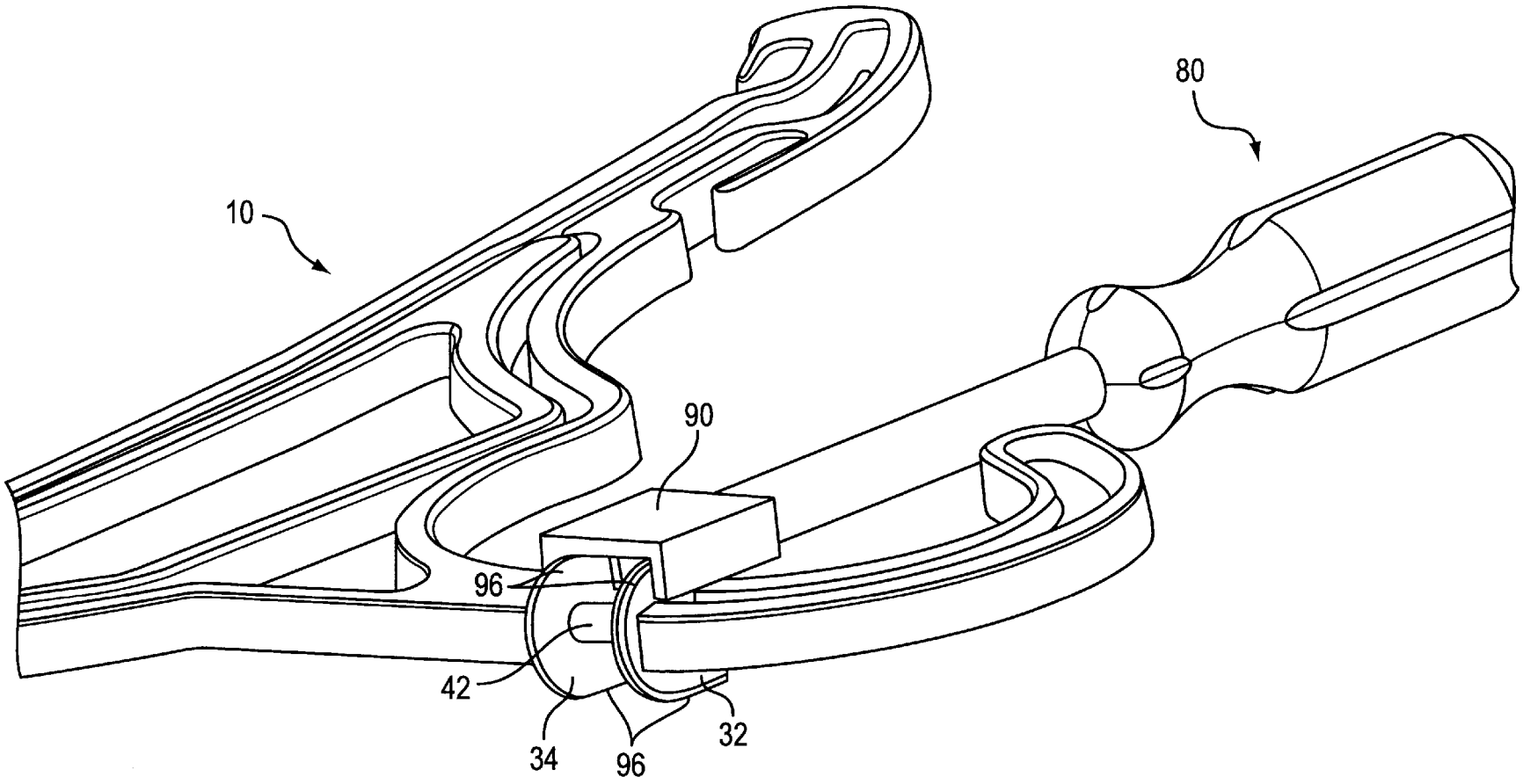
FIG. 13 is a perspective view of the hand tool of FIG. 1 aligned over the guide surfaces of the hanger of FIG. 1 with the marker removed for clarity.
Figure 14:
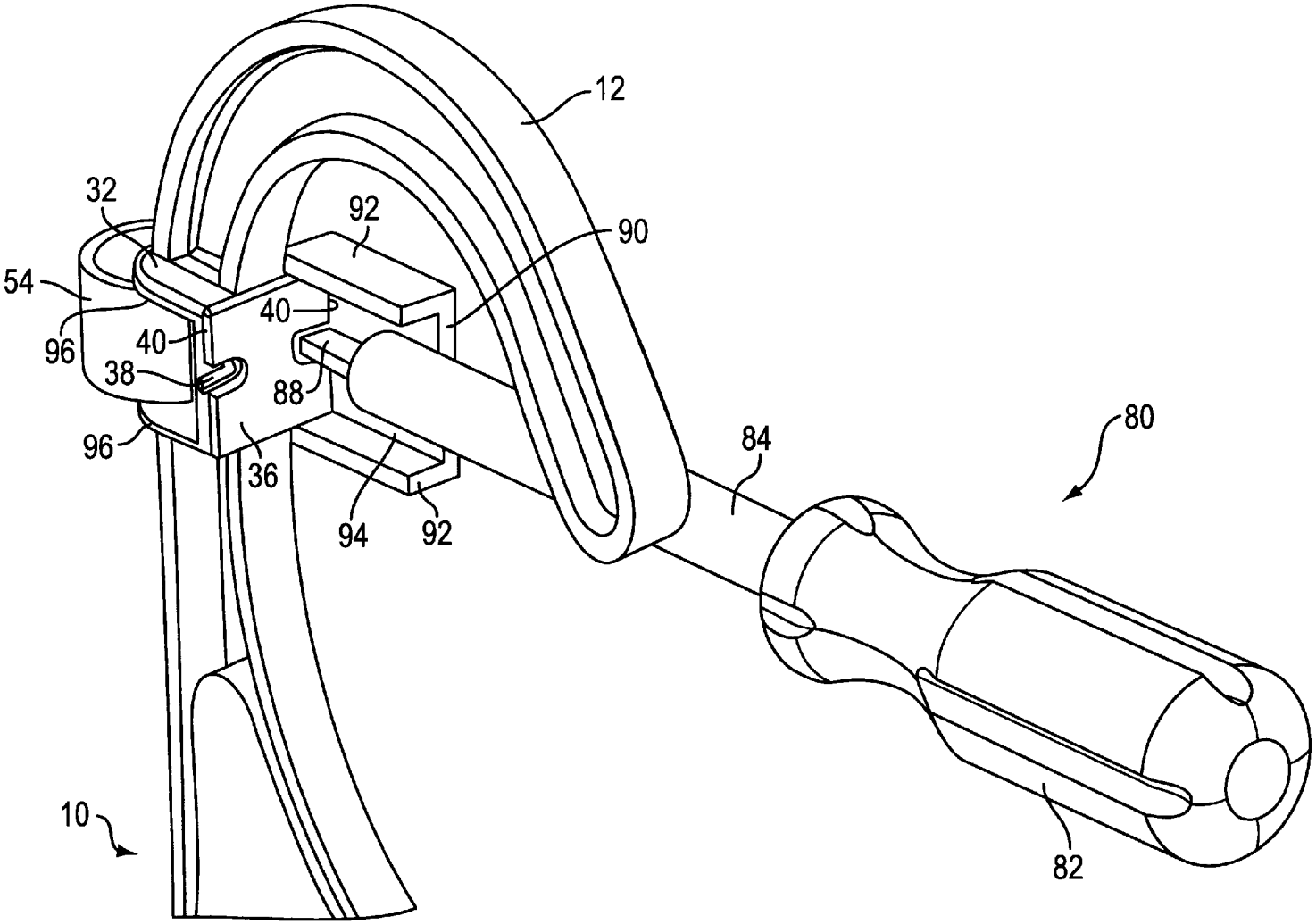
FIG. 14 is a perspective view of the tool of FIG. 12 engaged with the hanger of FIG. 1 and marker of FIG. 2 during an initial phase of marker removal.
Figure 15:
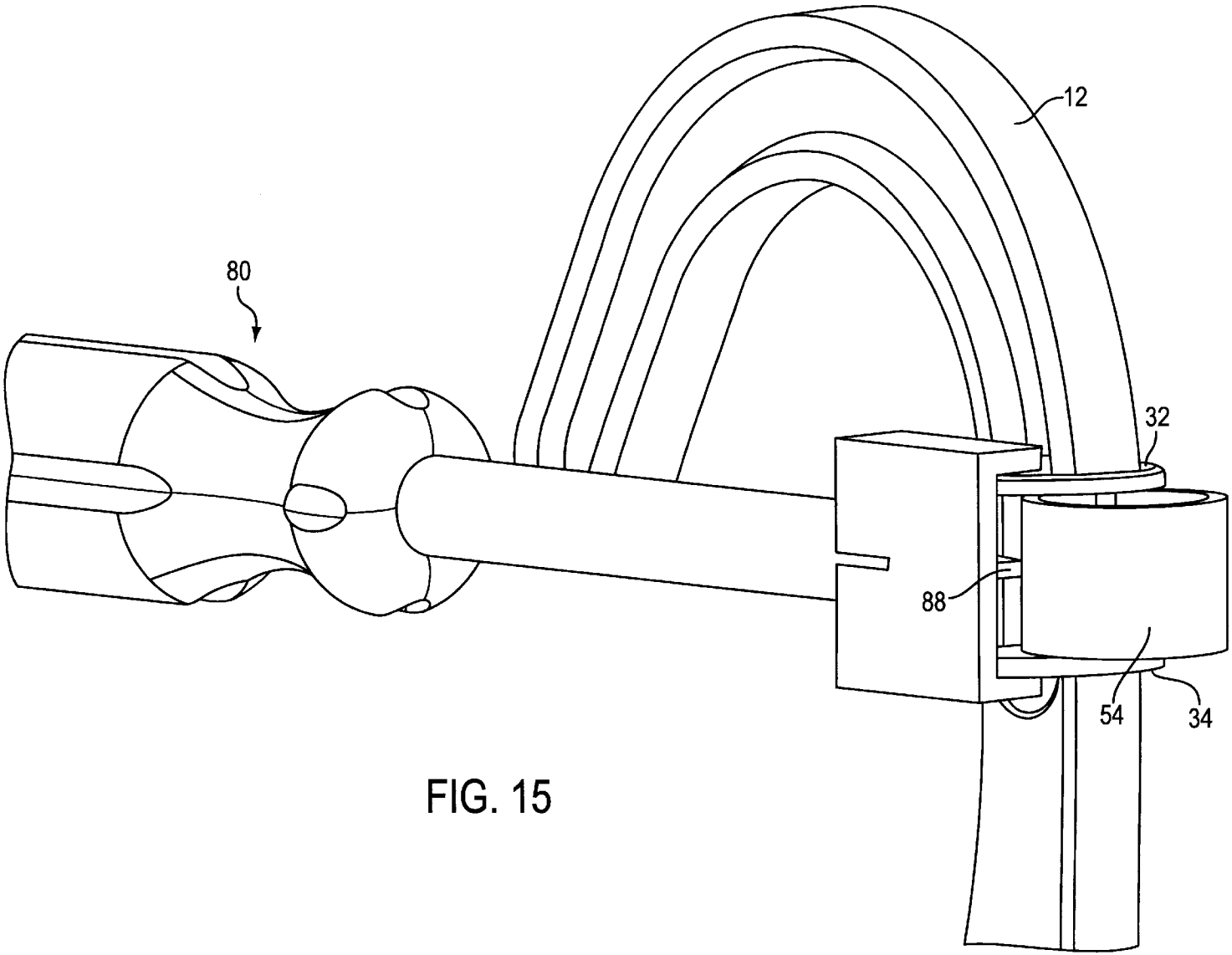
FIG. 15 is an enlarged perspective view of the tool, hanger and marker of FIG. 14 during a final phase of marker removal.

As seen in FIGS. 13, 14 and 15, the removal head 86 of the removal tool 80 is dimensioned to slide over the side edges 96 of the upper and lower guide surfaces 32,34 and thereby align removal blade 88 with slot 38. Further alignment is provided as the inner surface 94 of base wall 90 slides over and aligns with one of the sides 40 of wall 36.

In this manner, as tool 80 is pushed into either slot 38, the tool blade 88 engages the sleeve 56 of marker 54 adjacent the open mouth 58 of the marker and pushes the marker away from wall 36 as shown in FIG. 14. Further sliding movement of the tool head adjacent guide surfaces 32, 34 causes the tool blade 88 to completely unseat the marker 54 from socket 30 as the plastic fingers 62 snap out of contact with rod 42.

Additional stability and guidance are provided to tool 80 during marker removal by sliding the tool shaft 84 against the tip of the hooked portion 12 of hanger 10 as shown in FIGS. 13 and 14.

There has been disclosed heretofore the best embodiment of the invention presently contemplated However, it is to be understood that various changes and modifications may be made thereto without departing from the spirit of the invention.

What is claimed is:

1. A garment hanger marker removal system, comprising:

a garment hanger having a garment marker mounting structure provided on said hanger, said mounting structure comprising a roof projecting outwardly from said hanger, a floor separated from said roof and projecting outwardly from said hanger, a wall extending between said roof and said floor, a rod spaced apart from said wall and connected to said roof and said floor, and at least one slot formed through said wall between said roof and said floor;

a garment marker removably mounted on said rod, said marker comprising a substantially cylindrical sleeve having a pair of opposed axially-extending edges defining an open mouth for receiving said rod and a spoked array of retention fingers extending radially inwardly into said sleeve and circumferentially engaged around said rod, said roof and said floor extending substantially completely over said marker with said marker being closely spaced from said roof and said floor and engageable with said wall; and a marker removal tool having a head comprising a pair of opposed side walls respectively slidable over said roof and said floor and defining a channel therebetween, and a removal prong rigidly fixed in position on said head with a fixed spacing between said side walls such that placement of said head over said roof and said floor aligns said removal prong with said slot formed in said wall to allow said removal prong to engage said marker and remove said marker from said rod.

2. The system of claim 1, wherein said at least one slot formed through said wall comprises a first slot and a second slot formed through said wall.

3. The system of claim 1, wherein said wall comprises a rib extending toward and spaced apart from rod, and wherein said rib is engageable with said mouth on said marker to prevent rotation of said marker around said rod.

4. The system of claim 3, wherein said rib extends substantially parallel to said rod.

5. The system of claim 1, wherein said roof and said floor are substantially horizontally disposed and mutually parallel, and wherein said wall extends vertically between said roof and said floor.

6. The system of claim 1, wherein said head comprises a base wall located between said side walls and wherein said removal prong comprises a blade connected to said base wall.

7. The system of claim 1, wherein said slot is located in said wall midway between said roof and said floor.

* * * * *